US011638483B2

(12) United States Patent
Sun et al.

(10) Patent No.: US 11,638,483 B2
(45) Date of Patent: May 2, 2023

(54) CHAIR BACKREST MECHANISM, CHAIR FRAME AND CHAIR

(71) Applicant: HAINING HELI MACHINERY & TECHNOLOGY CO., LTD., Jiaxing (CN)

(72) Inventors: Xiqi Sun, Jiaxing (CN); Xiaozhao Zhang, Jiaxing (CN); Qiu Xu, Jiaxing (CN); Mengjie Li, Jiaxing (CN)

(73) Assignee: HAINING HELI MACHINERY & TECHNOLOGY CO., LTD., Jiaxing (CN)

( * ) Notice: Subject to any disclaimer, the term of this patent is extended or adjusted under 35 U.S.C. 154(b) by 0 days.

(21) Appl. No.: 17/667,561

(22) Filed: Feb. 9, 2022

(65) Prior Publication Data

US 2022/0378206 A1 Dec. 1, 2022

(30) Foreign Application Priority Data

May 27, 2021 (CN) ..... 202121167996.7

(51) Int. Cl.

| | |
|---|---|
| ***A47C 1/035*** | (2006.01) |
| ***A47C 1/031*** | (2006.01) |
| ***A47C 1/0355*** | (2013.01) |
| ***A47C 7/56*** | (2006.01) |

(52) U.S. Cl.

CPC ..... *A47C 1/0355* (2013.01)

(58) Field of Classification Search

CPC . A47C 1/0355; A47C 1/0242; A47C 1/03211; A47C 1/034; A47C 7/506; A47C 7/5068

See application file for complete search history.

(56) References Cited

U.S. PATENT DOCUMENTS

| | | | | |
|---|---|---|---|---|
| 5,217,276 | A * | 6/1993 | LaPointe | A47C 1/0355 297/85 L |
| 5,772,278 | A * | 6/1998 | Kowalski | A47C 1/0355 297/85 L |
| 10,736,426 | B2 * | 8/2020 | Fei | A47C 7/38 |
| 10,842,273 | B2 * | 11/2020 | Fei | A47C 1/0355 |
| 11,140,990 | B2 * | 10/2021 | Sun | A47C 1/024 |
| 11,540,633 | B2 * | 1/2023 | Zhang | A47C 7/563 |
| 2011/0175404 | A1 * | 7/2011 | Lawson | A47C 3/027 297/83 |
| 2011/0175426 | A1 * | 7/2011 | Lawson | A47C 1/0355 297/85 M |

(Continued)

*Primary Examiner* — Shin H Kim

(57) ABSTRACT

A chair backrest mechanism, a chair frame and a chair are provided, including a back supporting member, a hip and leg supporting member, a swing traction unit, a linkage member and an auxiliary traction member. The hip and leg supporting member includes a leg supporting portion and a hip supporting portion. The back supporting member is movably connected to the hip and leg supporting member by the swing traction unit. The auxiliary traction member is pivotally connected to the swing traction unit and includes a first pin joint portion and a second pin joint portion, the first pin joint portion is pivotally connected to the hip supporting portion, the second pin joint portion is pivotally connected to a first end of the linkage member, and a second end of the linkage member away from the second pin joint portion is pivotally connected to the back supporting member.

20 Claims, 6 Drawing Sheets

(56) References Cited

U.S. PATENT DOCUMENTS

| | | | | |
|---|---|---|---|---|
| 2012/0049606 | A1* | 3/2012 | Lawson | A47C 1/0342<br>74/521 |
| 2014/0021760 | A1* | 1/2014 | Masters | A47C 1/0355<br>297/313 |
| 2015/0289655 | A1* | 10/2015 | Lawson | A47C 1/0342<br>297/75 |
| 2016/0029800 | A1* | 2/2016 | Bryant | A47C 1/0242<br>297/284.3 |
| 2017/0071358 | A1* | 3/2017 | Huang | A47C 1/0355 |
| 2020/0163458 | A1* | 5/2020 | Murphy | A47C 1/0355 |
| 2022/0071397 | A1* | 3/2022 | Zhang | A47C 1/0355 |
| 2022/0378206 | A1* | 12/2022 | Sun | A47C 1/0355 |

* cited by examiner

CHAIR BACKREST MECHANISM, CHAIR FRAME AND CHAIR

CROSS-REFERENCE TO RELATED APPLICATIONS

This application claims all benefits accruing under 35 U.S.C. § 119 from China Patent Application No. 202121167996.7, filed on May 27, 2021, titled "CHAIR BACKREST MECHANISM, CHAIR FRAME AND CHAIR" in the China National Intellectual Property Administration, the content of which is hereby incorporated by reference.

TECHNICAL FIELD

The present disclosure generally relates to chairs, and in particular, to a chair backrest mechanism, a chair frame and a chair.

BACKGROUND

At present, a chair frame is provided to adjust sitting postures of a user. Such chair frame includes a chair backrest mechanism configured to adjust a supporting angle of a backrest. An angle of the chair backrest mechanism relative to a fixed base or the ground can change as the chair frame switches among three different postures of the user which can include sitting, leisure and lying.

The chair backrest mechanism may include a back supporting member which can rotate relative to a hip and leg supporting member. In practice, when the back supporting member rotates relative to the hip and leg supporting member, an end of the back supporting member away from the hip and leg supporting member will produce a backward motion component in the horizontal direction, thus driving the chair backrest to move backward, which leads to interference and collision between the chair backrest and an indoor wall or an indoor facility, causing inconvenience to the user.

SUMMARY

Thus, it is desired to provide a chair backrest mechanism, a chair frame and a chair.

The present disclosure provides a chair backrest mechanism including a back supporting member, a hip and leg supporting member, a swing traction unit, a linkage member and an auxiliary traction member. The hip and leg supporting member includes a leg supporting portion and a hip supporting portion. The back supporting member is movably connected to the hip and leg supporting member by the swing traction unit, the auxiliary traction member is pivotally connected to the swing traction unit, the auxiliary traction member includes a first pin joint portion and a second pin joint portion, the first pin joint portion is pivotally connected to the hip supporting portion, the second pin joint portion is pivotally connected to a first end of the linkage member, and a second end of the linkage member away from the second pin joint portion is pivotally connected to the back supporting member. The swing traction unit is connected to a driving mechanism. The swing traction unit is capable of driving the back supporting member to move towards the leg supporting portion under a forward driving of the driving mechanism, or driving the back supporting member to move away from the leg supporting portion under a reverse driving of the driving mechanism.

The chair backrest mechanism provided in the present disclosure can improve a connecting relationship between the back supporting member and the hip and leg supporting member by adding the linkage member, the auxiliary traction member and the swing traction unit. When the chair backrest mechanism switches from a leisure state to a lying state, the back supporting member is driven to produce a forward motion component in the horizontal direction, so as to drive the chair backrest to move towards the front of a human body and give way to a wall or facility behind the human body. It overcomes the interference and collision between the chair backrest and an indoor wall or an indoor facility.

In an embodiment of the present disclosure, the swing traction unit includes a swing member and a backrest traction member pivotally connected to each other, the swing member is further pivotally connected to the hip supporting portion and configured to connect to the driving mechanism, and the backrest traction member is further pivotally connected to the back supporting member. The auxiliary traction member further includes a third pin joint portion fixed relative to the first pin joint portion and the second pin joint portion, and the auxiliary traction member is pivotally connected to the backrest traction member by the third pin joint portion.

In this way, the swing member can indirectly transmit a power of the driving mechanism to the backrest traction member, and the backrest traction member can produce a larger swing traction at an end away from the swing member thereof under the driving of the swing member, so that a motion traction and a force transmission on the back supporting member are better, and the back supporting member gives way to the wall or facility behind the user with a larger displacement. At the same time, the power of the driving mechanism can also be indirectly transmitted to the auxiliary traction member, and the auxiliary traction member further provides an auxiliary traction to the back supporting member.

In an embodiment of the present disclosure, the auxiliary traction member includes a first rod and a second rod, and the first pin joint portion and the third pin joint portion are located at both ends of the first rod respectively. The second rod is convex on a side of the first rod, an oblique angle is formed between the first rod and the second rod, and the second pin joint portion is located at an end of the second rod away from the first rod.

In this way, the second rod is convex outward along the side of the first rod and an angle is formed between the first rod and the second rod, resulting in an increase in a length of a force arm of the auxiliary traction member when the auxiliary traction member transfers traction force to the linkage member, which is conducive to reducing an interaction force between the linkage member and the auxiliary traction member, and thus reducing wear and crushing between the linkage member and the auxiliary traction member.

In an embodiment of the present disclosure, the first rod is integrated with the second rod; and/or a length of the second rod is less than that of the first rod, and a distance between an end of the second rod connected to the first rod and the third pin joint portion is at least three times longer than a distance between the end of the second rod connected to the first rod and the first pin joint portion.

In this way, an overall strength and a reliability of the auxiliary traction member are better, and a structure of the auxiliary traction member is conducive to increasing a displacement of the linkage member relative to the hip and leg supporting member in the vertical direction, while reducing a displacement of the linkage member relative to the hip and leg supporting member in the horizontal direction at the same time, driving the back supporting member to rotate faster in order to coordinate an angle adjustment and a horizontal forward movement of the chair backrest.

In an embodiment of the present disclosure, the linkage member includes a third rod and a fourth rod. A first end of the third rod is pivotally connected to the back supporting member, a second end of the third rod is fixed to the fourth rod, an end of the fourth rod away from the third rod is pivotally connected to the second pin joint portion, and a bending angle is formed between the third rod and the fourth rod.

In this way, a structure of the linkage member can be better adapted to the structure of the auxiliary traction member.

In an embodiment of the present disclosure, the hip supporting portion, the swing traction unit and the auxiliary traction member form a first connecting rod mechanism, which is configured to drive an end connected to the back supporting member of the swing traction unit to move towards or away from the leg supporting portion. The auxiliary traction member, the swing traction unit, the back supporting member and the linkage member form a second connecting rod mechanism, which is configured to change a supporting angle of the back supporting member.

In this way, a motion trajectory of the chair backrest mechanism provided in the present disclosure is more accurate, which can ensure that the motion trajectory of the chair backrest mechanism still has good consistency and accuracy after using repeatedly. In addition, it also allows the chair backrest mechanism to respond more quickly and sensitively to a power output of the driving mechanism.

The present disclosure further provides a chair frame including a fixed base, a driving mechanism, an adjusting mechanism for sitting postures and the chair backrest mechanism as described above. The fixed base is configured to mount the driving mechanism and the adjusting mechanism for sitting postures, the driving mechanism is connected to the adjusting mechanism for sitting postures for driving, and the adjusting mechanism for sitting postures is movably connected to the hip and leg supporting member and the swing traction unit.

In an embodiment of the present disclosure, the chair frame further includes a footrest extension mechanism which is pivotally connected to the leg supporting portion, the driving mechanism is connected to the footrest extension mechanism for driving, and the adjusting mechanism for sitting postures is connected to the footrest extension mechanism for following moving thereof. The driving mechanism is capable of running forward to drive the footrest extension mechanism to extend relative to the hip and leg supporting member, and driving the swing traction unit to move by the adjusting mechanism for sitting postures, resulting in driving the back supporting member to move towards the leg supporting portion, or the driving mechanism is capable of running in reverse to drive the adjusting mechanism for sitting postures, resulting in making the swing traction unit to drive the back supporting member to move away from the leg supporting portion and drive the footrest extension mechanism to retract relative to the hip and leg supporting member.

In this way, a power produced by the driving mechanism is transmitted to the swing traction unit through the footrest extension mechanism and the adjusting mechanism for sitting postures in turn, achieving a linkage operation of the footrest extension mechanism and the chair backrest mechanism, resulting in that a leg extension and a back reclining of the user are carried out simultaneously, or a leg retraction and a back forward tilting are carried out simultaneously, thus further enhancing coordination of movement, comfort and convenience of the chair frame.

In an embodiment of the present disclosure, the chair frame further includes a first transmission rocker arm, a first transmission connecting rod and a second transmission connecting rod, the first transmission rocker arm is rotationally mounted on the hip and leg supporting member, both ends of the first transmission connecting rod are pivotally connected to a first end of the first transmission rocker arm and the adjusting mechanism for sitting postures respectively, and both ends of the second transmission connecting rod are pivotally connected to a second end of the first transmission rocker arm and the footrest extension mechanism respectively.

The present disclosure further provides a chair including the chair frame as described above.

In the figures, 100 represents a chair backrest mechanism; 10 represents a back supporting member; 11 represents a backrest mounting tappet; 20 represents a hip and leg supporting member; 21 represents a leg supporting portion; 22 represents a hip supporting portion; 30 represents a swing traction unit; 31 represents a swing member; 32 represents a backrest traction member; 40 represents a linkage member; 401 represents a third rod; 402 represents a fourth rod; 50 represents an auxiliary traction member; 501 represents a first rod; 502 represents a second rod; 51 represents a first pin joint portion; 52 represents a second pin joint portion; 53 represents a third pin joint portion; 200 represents a chair frame; 210 represents a fixed base; 211 represents a slide rail; 221 represents a driving body; 222 represents a driving connecting rod; 223 represents a torsion connecting rod; 224 represents a driving source; 231 represents a first supporting arm; 232 represents a second supporting arm; 233 represents a first movable connecting rod; 234 represents a second movable connecting rod; 241 represents a first transmission rocker arm; 242 represents a first transmission connecting rod; 243 represents a second transmission connecting rod; 250 represents a footrest extension mechanism.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without making creative labor are the scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

Figure 1:
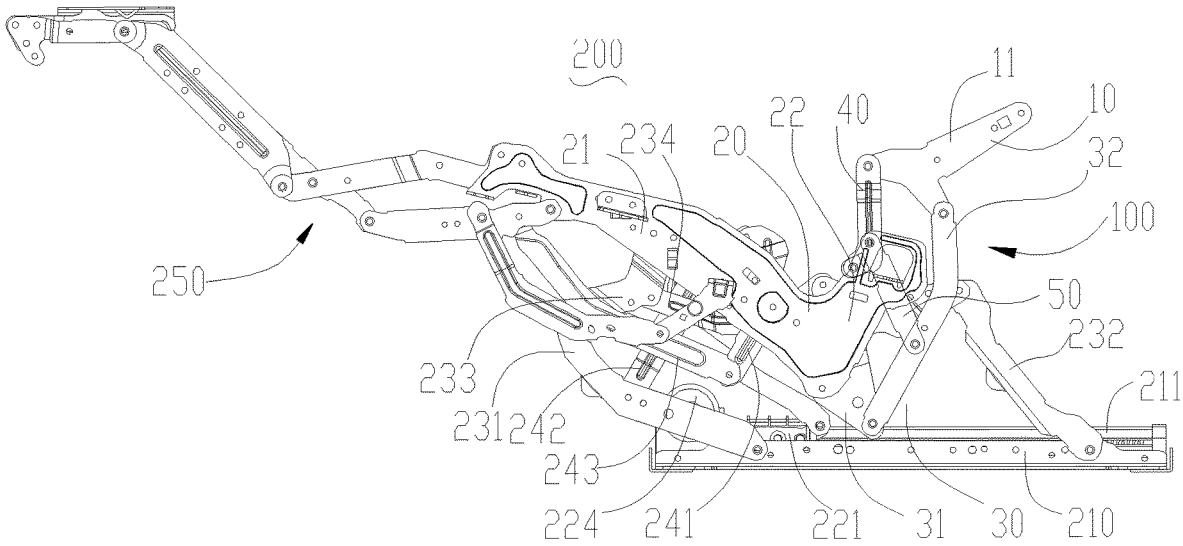
FIG. 1 is a schematic diagram of a chair frame in a lying state in an embodiment of the present disclosure.
Figure 2:
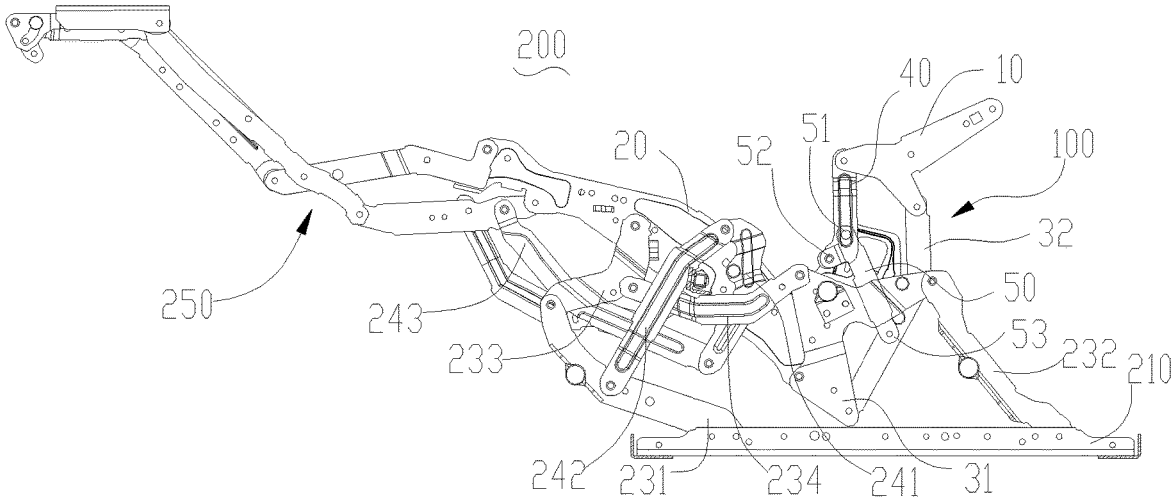
FIG. 2 is a schematic diagram of part of the structure of the chair frame in FIG. 1.
Figure 3:
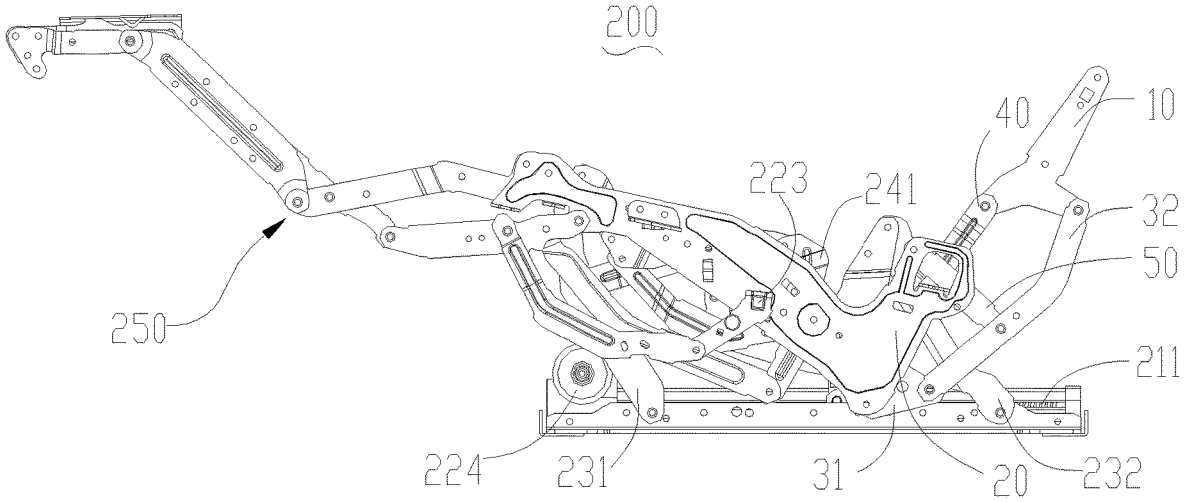
FIG. 3 is a schematic diagram of a chair frame in a leisure state in an embodiment of the present disclosure.
Figure 4:
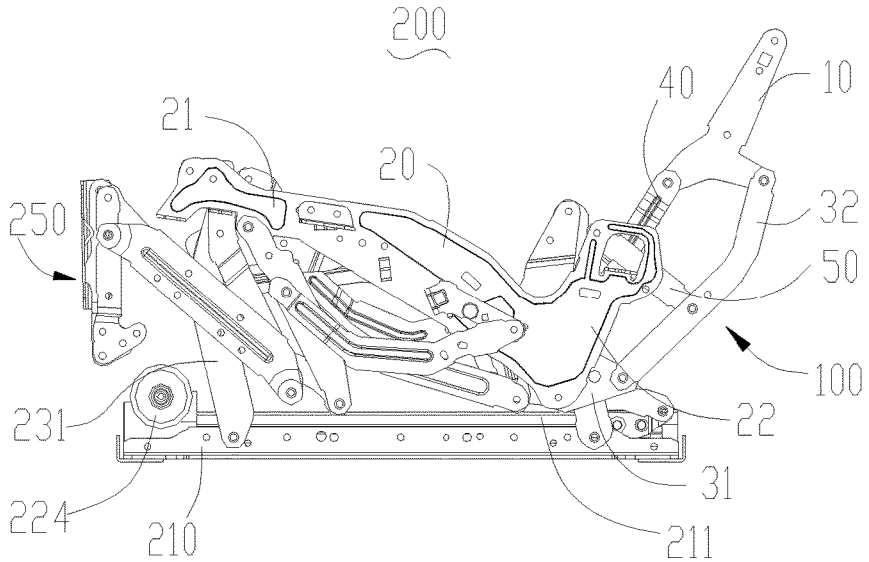
FIG. 4 is a schematic diagram of a chair frame in a sitting state in an embodiment of the present disclosure.
Figure 5:
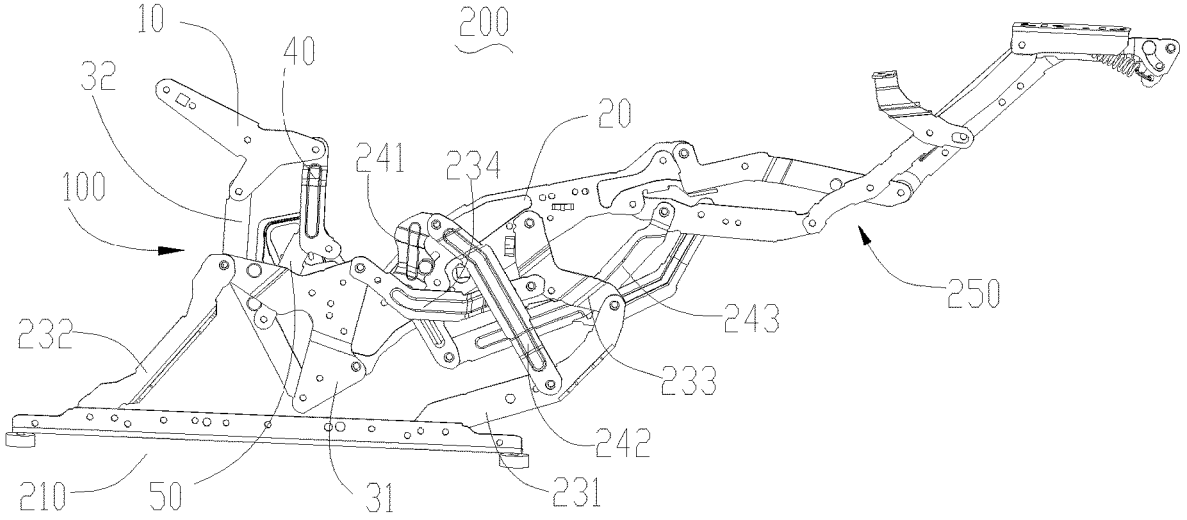
FIG. 5 is a schematic diagram of part of the structure of the chair frame in FIG. 1.

FIG. 1 is a schematic diagram of a chair frame 200 in a lying state in an embodiment of the present disclosure. FIG. 2 is a schematic diagram of part of the structure of the chair frame 200 in FIG. 1. FIG. 3 is a schematic diagram of the chair frame 200 in a leisure state in an embodiment of the present disclosure. FIG. 4 is a schematic diagram of the chair frame 200 in a sitting state in an embodiment of the present disclosure. FIG. 5 is a schematic diagram of part of the structure of the chair frame 200 in FIG. 1.

The present disclosure provides a chair backrest mechanism 100 mounted on the chair frame 200. The chair frame 200 is placed on the ground by a fixed base 210 thereof, and the chair backrest mechanism 100 is configured to connect to a shoulder and neck supporting member (not shown). The chair backrest mechanism 100 may move relative to the fixed base 210 in the chair frame 200, changing an angle between the shoulder and neck supporting member and the ground, and thus changing a supporting angle for a back of the user.

Specifically, the chair backrest mechanism 100 in the present disclosure is applied to the chair frame 200 which is movable and provided with a footrest extension mechanism 250. The chair frame 200 has a sitting state corresponding to the back of the user being straight and the leg of the user being retracted, a leisure state corresponding to the back of the user being tilted and the leg of the user being extended, and a lying state corresponding to the back of the user being lied down and the leg of the user being extended.

The chair backrest mechanism 100 includes a back supporting member 10 and a hip and leg supporting member 20 connected movably. The back supporting member 10 is mainly configured to bear a weight of the lower back and support the waist of the user, and includes a backrest mounting tappet 11 for mounting the shoulder and neck supporting member. The hip and leg supporting member 20 is mainly configured to bear a weight of legs and the hip of the user, and includes a leg supporting member 21 and a hip supporting member 22 fixed relative to each other. In an embodiment, an angle is formed between the leg supporting member 21 and the hip supporting member 22, and a shape of the hip and leg supporting member 20 is substantially L-shaped.

When the chair frame is switched among the sitting state, the leisure state and the lying state, the back supporting member 10 rotates relative to the hip and leg supporting member 20. In the sitting state as shown in FIG. 4, an angle between the backrest mounting tappet 11 of the back supporting member 10 and the fixed base 210 reaches a maximum, and the back of the user is nearly straight in the vertical direction. In the leisure state as shown in FIG. 3, the angle between the backrest mounting tappet 11 and the fixed base 210 decreases, and the back of the user is tilted backward. In the lying state as shown in FIG. 1 and FIG. 2, the angle between the backrest mounting tappet 11 and the fixed base 210 further decreases and reaches a minimum, and the back of the user is close to the horizontal direction.

A conventional chair backrest mechanism includes a conventional back supporting member which may rotate relative to a conventional hip and leg supporting member. In practice, when the conventional back supporting member rotates relative to the conventional hip and leg supporting member, an end of the conventional back supporting member away from the conventional hip and leg supporting member will also produce a backward motion component in the horizontal direction, thus driving the chair backrest to a rear of a human body, which leads to interference and collision between the conventional chair backrest and an indoor wall or an indoor facility, causing inconvenience to the user.

Therefore, the chair backrest mechanism provided in the present disclosure further includes a swing traction unit 30, a linkage member 40 and an auxiliary traction member 50. The back supporting member 10 is movably connected to the hip and leg supporting member 20 by the swing traction unit 30, and the auxiliary traction member 50 is pivotally connected to the swing traction unit 30. The auxiliary traction member 50 includes a first pin joint portion 51 and a second pin joint portion 52, the first pin joint portion 51 is pivotally connected to the hip supporting portion 22, the second pin joint portion 52 is pivotally connected to a first end of the linkage member 40, and a second end away from the second pin joint portion 52 of the linkage member 40 is pivotally connected to the back supporting member 10.

The chair frame 200 is further provided with a driving mechanism configured to provide power for adjusting states of the chair frame 200 and changing an angle of the chair backrest mechanism 100. The driving mechanism is connected to the swing traction unit 30, and the driving mechanism is capable of running forward to drive the back supporting member 10 to move towards the leg supporting member 21, i.e., move towards the front of the user. Alternatively, the driving mechanism is capable of running in reverse to drive the back supporting member 10 to move away from the leg supporting member 21, i.e., move towards the rear of the user.

It should be noted that a directional reference to the front of the user and the rear of the user involved in the present disclosure refers to the front or the rear of the user after the user sits/lies on the chair frame 200.

The present disclosure provides a chair backrest mechanism 100. The chair backrest mechanism 100 may improve a connecting relationship between the back supporting member 10 and the hip and leg supporting member 20 by adding the linkage member 40, the auxiliary traction member 50 and the swing traction unit 30. When the chair backrest mechanism 100 is switched from the leisure state to the lying state, the back supporting member 10 is driven to produce a forward motion component in the horizontal direction, so as to drive the chair backrest to move towards the front of a human body and give way to a wall or facility behind the human body. It overcomes the interference and collision between the chair backrest and the indoor wall or the indoor facility.

Figure 9:
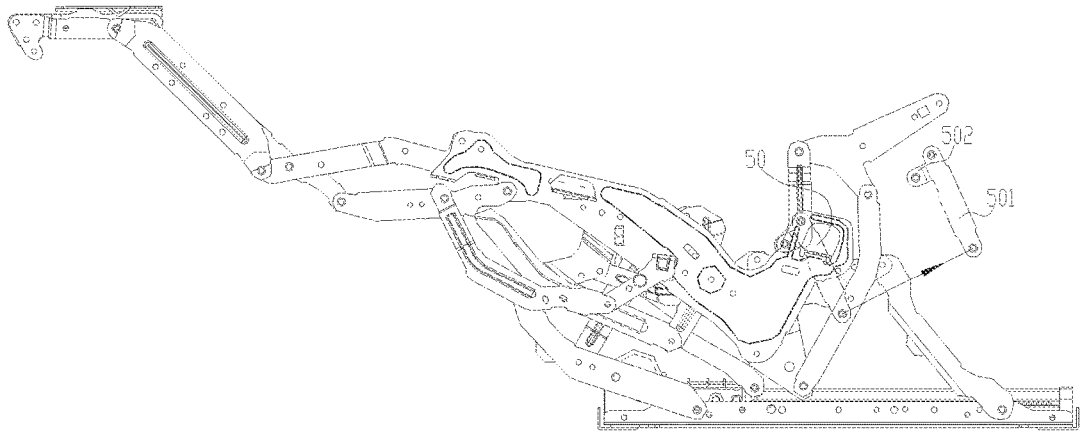
FIG. 9 is a schematic diagram of an auxiliary traction member in a chair frame in FIG. 1.

Referring to FIG. 1, FIG. 2 and FIG. 9, in an embodiment of the present disclosure, the auxiliary traction member 50 includes a first rod 501 and a second rod 502, and the first rod 501 is integrated with the second rod 502. The second rod 502 is convex on a side of the first rod 501 and an oblique angle is formed between the first rod 501 and the second rod 502. A first end of the first rod 501 is provided with the first pin joint portion 51, a second end of the first rod is provided with the third pin joint portion 53. An end away from the first rod 501 of the second rod 502 is provided with the second pin joint portion 52.

Furthermore, the swing traction unit 30 includes a swing member 31 and a backrest traction member 32 pivotally connected to each other, the swing member 31 is further pivotally connected to an end of the hip supporting portion 22 close to the leg supporting portion 21 and configured to connect to the driving mechanism and transfer the power to the whole chair backrest mechanism 100. An end of the backrest traction member 32 away from the swing member 31 is pivotally connected to the back supporting member 10 and configured to transfer the power of the swing member 31 to the back supporting member 10 and the auxiliary traction member 50.

The first pin joint portion 51 is pivotally connected to an end away from the leg supporting portion 21 of hip supporting portion 22, the second pin joint portion 52 is pivotally connected to the first end away from the back supporting member 10 of the linkage member 40, and the third pin joint portion 53 is pivotally connected to the backrest traction member 32. A pivot point between the third pin joint portion 53 and the backrest traction member 32 is located between a pivot point between the backrest traction member 32 and the swing member 31 and a pivot point between the backrest traction member 32 and the back supporting member 10.

In the above embodiment, the hip supporting portion 22, the swing member 31, the backrest traction member 32 and the auxiliary traction member 50 form a first connecting rod mechanism. The first connecting rod mechanism can be regarded as a four-rod connecting mechanism and configured to drive an end of the backrest traction member 32 connected to the back supporting member 10 to move towards or away from the leg supporting portion 21. In other words, the backrest traction member 32, driven by the swing member 31, may produce a component that drives the back supporting member 10 to move towards the front or the rear of the user.

Furthermore, in the above embodiment, the auxiliary traction member 50, the swing traction unit 32, the back supporting member 10 and the linkage member 40 form a second connecting rod mechanism. The second connecting rod mechanism can be regarded as a four-rod connecting mechanism and configured to change a supporting angle of the back supporting member 10.

Specifically, the second connecting rod mechanism may provide power to the linkage member 40 by the auxiliary traction member 50, which causes the second end of the linkage member 40 connected to the back supporting member 10 to produce a significant motion component of motion in the vertical direction, so as to cause the back supporting member 10 to produce a significant rotation component. When the chair frame 200 is switched from the leisure state to the lying state, the linkage member 40 may quickly drive the backrest mounting tappet 11 of the back supporting member 10 to rotate in a clockwise direction shown in FIG. 3 to a position shown in FIG. 2.

In this way, a motion trajectory of the chair backrest mechanism 100 is more accurate, which can ensure that the motion trajectory of the chair backrest mechanism 100 still has good consistency and accuracy after using repeatedly. In addition, it also allows the chair backrest mechanism 100 to respond more quickly and sensitively to a power output of the driving mechanism.

Figure 10:
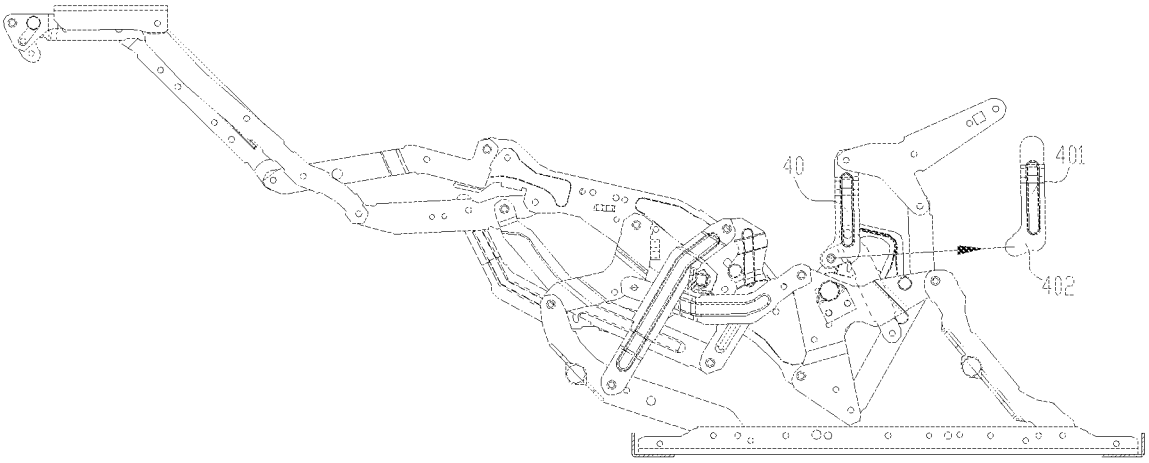
FIG. 10 is a schematic diagram of a linkage member in a chair frame in FIG. 1.

Furthermore, referring to FIG. 1, FIG. 2 and FIG. 10, a length of the second rod 502 is less than that of the first rod 501, and a distance between an end of the second rod 502 connected to the first rod 501 and the third pin joint portion 53 is at least three times longer than a distance between the end of the second rod 502 connected to the first rod 501 and the first pin joint portion 51.

The linkage member 40 includes a third rod 401 and a fourth rod 402 which are integrated and bent. A bending angle is formed between the third rod 401 and the fourth rod 402, a first end of the third rod 401 is pivotally connected to the back supporting member 10, a second end of the third rod 401 is fixed to the fourth rod 402, an end of the fourth rod 402 away from the third rod 401 is pivotally connected to the second pin joint portion 52.

Figure 6:
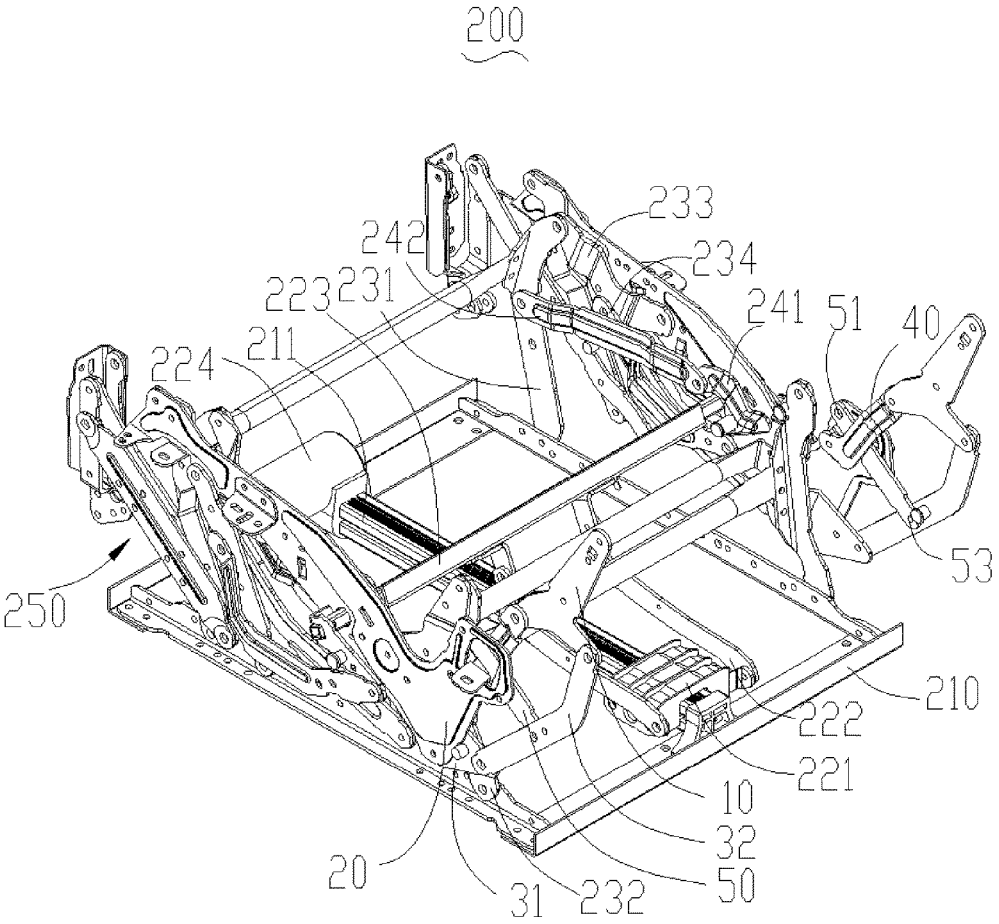
FIG. 6 is a schematic diagram of a three-dimensional structure of a chair frame in a sitting state in an embodiment of the present disclosure.
Figure 7:
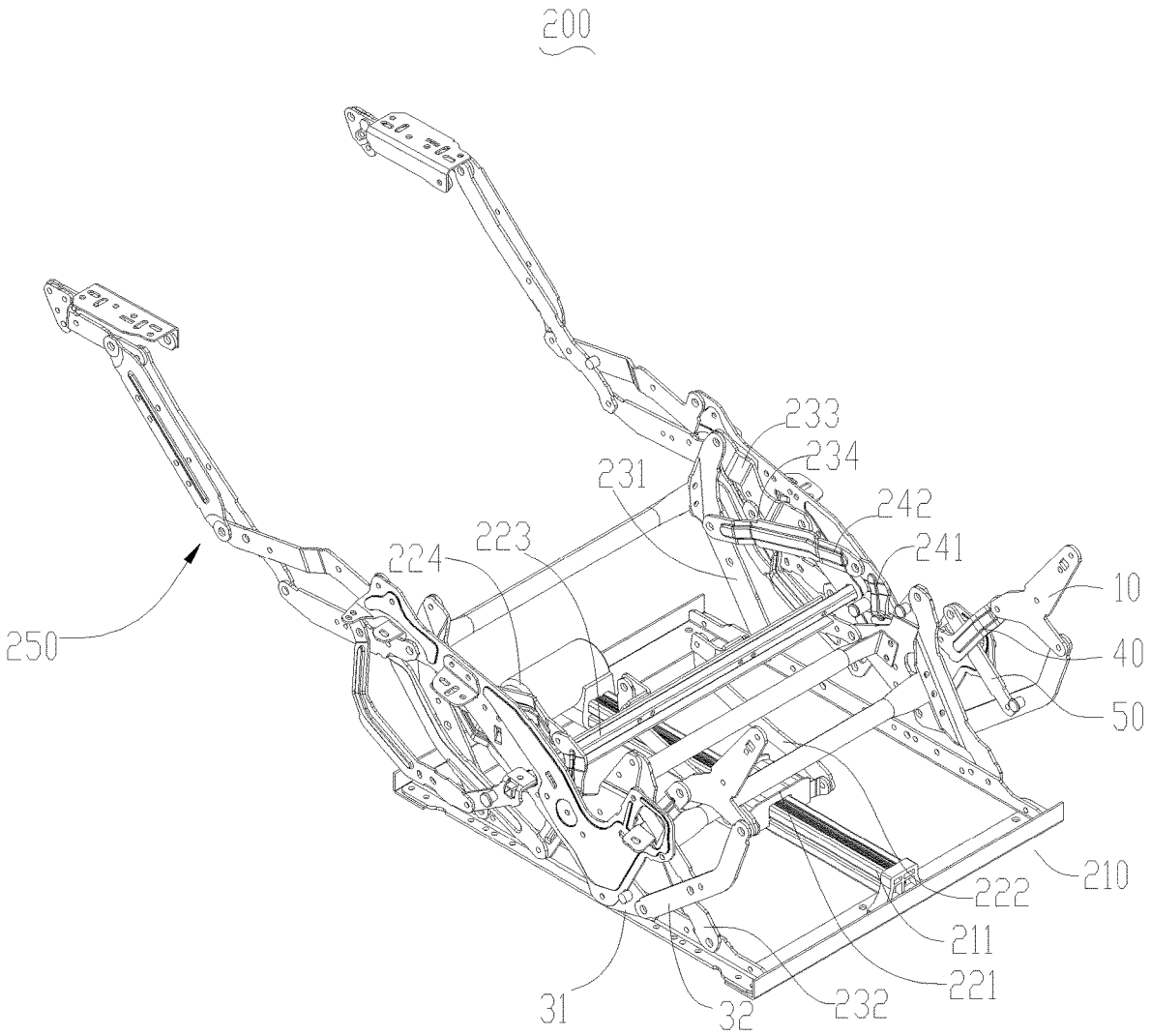
FIG. 7 is a schematic diagram of a three-dimensional structure of a chair frame in a leisure state in an embodiment of the present disclosure.
Figure 8:
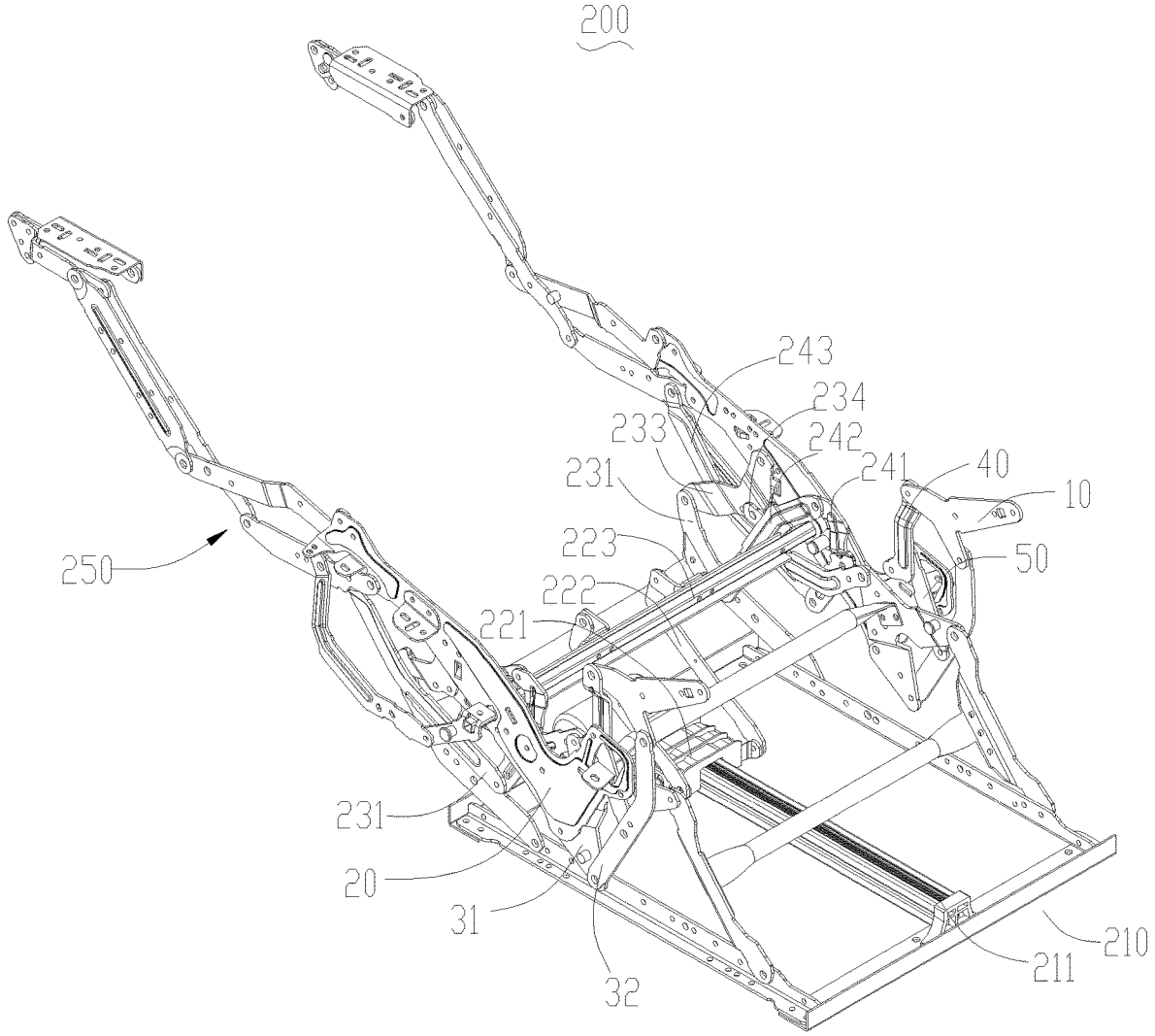
FIG. 8 is a schematic diagram of a three-dimensional structure of a chair frame in a lying state in an embodiment of the present disclosure.

FIG. 6 is a schematic diagram of a three-dimensional structure of the chair frame 200 in the sitting state in an embodiment of the present disclosure. FIG. 7 is a schematic diagram of a three-dimensional structure of the chair frame 200 in the leisure state in an embodiment of the present disclosure. FIG. 8 is a schematic diagram of a three-dimensional structure of the chair frame in the lying state in an embodiment of the present disclosure.

The present disclosure further provides the chair frame 200 including the fixed base 210, the chair backrest mechanism 100 as described above, the driving mechanism, an adjusting mechanism for sitting postures and the footrest extension mechanism 250.

The fixed base 210 is configured to mount the driving mechanism and the adjusting mechanism for sitting postures, and the footrest extension mechanism 250 is pivotally connected to the leg supporting portion 21. The driving mechanism is connected to the footrest extension mechanism 250 for driving and connected to the adjusting mechanism for sitting postures for driving by the footrest extension mechanism 250, resulting in that the adjusting mechanism for sitting postures may move with a movement of the footrest extension mechanism 250. The adjusting mechanism for sitting postures is movably connected to the hip and leg supporting member 20 and the swing traction unit 30.

The driving mechanism is capable of running forward to drive the footrest extension mechanism 250 to extend relative to the hip and leg supporting member 20, thus the chair frame 200 is switched from the sitting state to the leisure state. The driving mechanism drives the swing traction unit 30 by the adjusting mechanism for sitting postures, resulting in allowing the back supporting member 10 to move towards the leg supporting portion 21, thus the chair frame 200 is switched from the leisure state to the lying state.

The driving mechanism is also capable of running in reverse to drive the adjusting mechanism for sitting postures, resulting in making the swing traction unit 30 to drive the back supporting member 10 to move away from the leg supporting portion 21, thus the chair frame 200 is switched from the lying state to the leisure state. Then the driving mechanism may drive the footrest extension mechanism 250 to retract relative to the hip and leg supporting member 20, thus the chair frame 200 is switched from the leisure state to the sitting state.

Specifically, the driving mechanism includes a driving source 224, a driving body 221, a driving connecting rod 222 and a torsion connecting rod 223. The fixed base 210 includes a slide rail 211, both ends of which are corresponding to the leg supporting portion 21 and the hip supporting portion 22 respectively. The driving source 224 is fixed on the fixed base 210, the driving body 221 slides with the slide rail 211, the driving connecting rod 222 is pivotally connected to the driving body 221 and the torsion connecting rod 223, and the torsion connecting rod 223 is linked with the footrest extension mechanism 250, resulting in that the footrest extension mechanism 250 may move with a rotation of the torsion connecting rod 223 around an axis of the torsion connecting rod 223.

The driving body 221 is connected to the driving source 224 for following by a belt driving mechanism/chain driving mechanism provided along an extension direction of the slide rail 211. When the driving source 224 is running forward, the driving source 224 may drive the driving body 221 to slide along the slide rail 211 towards the front of the user, and the driving body 221 may drive the torsion connecting rod 223 to rotate in the clockwise direction as shown in FIG. 4 by the driving connecting rod 222, which in turn drives the footrest extension mechanism 250 to extend relative to the hip and leg supporting member 20. The above process corresponds to a switching of the chair frame 200 from the sitting state to the leisure state, and the hip and leg supporting member 20 moves a preset distance towards the front of the user.

After the footrest extension mechanism 250 is extended, the driving source 224 continues to drive the driving body 221 to slide towards the front of the user. At this time, the driving body 221 may drive the adjusting mechanism for sitting postures, and the adjusting mechanism for sitting postures may drive the swing member 31 to rotate in the clockwise direction as shown in FIG. 3, which in turn drives the chair backrest mechanism 100 to open. The above process corresponds to a switching of the chair frame 200 from the leisure state to the lying state. In the leisure state, the hip and leg supporting member 20 further moves a preset distance towards the front of the user.

When the driving source 224 reverses, the driving source 224 may drive the driving body 221 to slide along the slide rail 211 towards the rear of the user, and the driving body 221 may drive the torsion connecting rod 223 to rotate in an anticlockwise direction as shown in FIG. 1 and FIG. 2 by the driving connecting rod 222, which in turn drives the footrest extension mechanism 250 to retract relative to the hip and leg supporting member 20. The above process corresponds to a switching of the chair frame 200 from the lying state to the leisure state, and the hip and leg supporting member 20 moves a preset distance towards the rear of the user.

After the footrest extension mechanism 250 is retracted, the driving source 224 continues to drive the driving body 221 to slide towards the rear of the user. At this time, the driving body 221 may drive the adjusting mechanism for sitting postures, and the adjusting mechanism for sitting postures may drive the swing member 31 to rotate in the anticlockwise direction as shown in FIG. 3, which in turn drives the chair backrest mechanism 100 to return to the state as shown in FIG. 4. The above process corresponds to a switching of the chair frame 200 from the leisure state to sitting postures, and the hip and leg supporting member 20 further moves a preset distance towards the rear of the user.

The adjusting mechanism for sitting postures includes a first supporting arm 231, a second supporting arm 232, a first movable connecting rod 233 and a second movable connecting rod 234. Both ends of the first supporting arm 231 are pivotally connected to the fixed base 210 and the first movable connecting rod 233 respectively, both ends of the second supporting arm 232 are pivotally connected to the fixed base 210 and the swing member 31 respectively, the first movable connecting rod 233 is rotatably mounted on the hip and leg supporting member 20, and both ends of the second movable connecting rod 234 are pivotally connected to the first movable connecting rod 233 and the swing member 31 respectively.

Furthermore, the chair frame 200 further includes a first transmission rocker arm 241, a first transmission connecting rod 242 and a second transmission connecting rod 243, the first transmission rocker arm 241 is rotatably mounted on the hip and leg supporting member 20, both ends of the first transmission connecting rod 242 are pivotally connected to a first end of the first transmission rocker arm 241 and the adjusting mechanism for sitting postures, both ends of the second transmission connecting rod 243 are pivotally connected to a second end of the first transmission rocker arm 241 and the footrest extension mechanism 250.

A pivot point between the first transmission rocker arm 241 and the hip and leg supporting member 20 is located between the first end and the second end of the first transmission rocker arm 241. In this way, coordination of movement, comfort and convenience of the chair frame 200 are further enhanced.

The present disclosure further provides a chair (not shown) including the chair frame 200 as described above.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A chair backrest mechanism, comprising a back supporting member, a hip and leg supporting member, a swing traction unit, a linkage member and an auxiliary traction member, wherein the hip and leg supporting member comprises a leg supporting portion and a hip supporting portion;

the back supporting member is movably connected to the hip and leg supporting member by the swing traction unit, the auxiliary traction member is pivotally connected to the swing traction unit, the auxiliary traction member comprises a first pin joint portion and a second pin joint portion, the first pin joint portion is pivotally connected to the hip supporting portion, the second pin joint portion is pivotally connected to a first end of the linkage member, and a second end of the linkage member away from the second pin joint portion is pivotally connected to the back supporting member; and the swing traction unit is connected to a driving mechanism, the swing traction unit is capable of driving the back supporting member to move towards the leg supporting portion under a forward driving of the driving mechanism, or driving the back supporting member to move away from the leg supporting portion under a reverse driving of the driving mechanism.

2. The chair backrest mechanism of claim 1, wherein the swing traction unit comprises a swing member and a backrest traction member pivotally connected to each other, the swing member is further pivotally connected to the hip supporting portion and configured to connect to the driving mechanism, and the backrest traction member is further pivotally connected to the back supporting member; and the auxiliary traction member further comprises a third pin joint portion fixed relative to the first pin joint portion and the second pin joint portion, and the auxiliary traction member is pivotally connected to the backrest traction member by the third pin joint portion.

3. The chair backrest mechanism of claim 2, wherein the auxiliary traction member comprises a first rod and a second rod, and the first pin joint portion and the third pin joint portion are located at both ends of the first rod respectively; and the second rod is convex on a side of the first rod, an oblique angle is formed between the first rod and the second rod, and the second pin joint portion is located at an end of the second rod away from the first rod.

4. The chair backrest mechanism of claim 3, wherein the first rod is integrated with the second rod; and/or a length of the second rod is less than that of the first rod, and a distance between an end of the second rod connected to the first rod and the third pin joint portion is at least three times longer than a distance between the end of the second rod connected to the first rod and the first pin joint portion.

5. The chair backrest mechanism of claim 1, wherein the linkage member comprises a third rod and a fourth rod, a bending angle is formed between the third rod and the fourth rod; a first end of the third rod is pivotally connected to the back supporting member, a second end of the third rod is fixed to the fourth rod, and an end of the fourth rod away from the third rod is pivotally connected to the second pin joint portion.

6. The chair backrest mechanism of claim 1, wherein the hip supporting portion, the swing traction unit and the auxiliary traction member form a first connecting rod mechanism, which is configured to drive an end of the swing traction unit connected to the back supporting member to move towards or away from the leg supporting portion; and the auxiliary traction member, the swing traction unit, the back supporting member and the linkage member form a second connecting rod mechanism, which is configured to change a supporting angle of the back supporting member.

7. A chair frame, comprising a fixed base, a driving mechanism, an adjusting mechanism for sitting postures and the chair backrest mechanism of claim 1, wherein the fixed base is configured to mount the driving mechanism and the adjusting mechanism for sitting postures, the driving mechanism is connected to the adjusting mechanism for sitting postures for driving, and the adjusting mechanism for sitting postures is movably connected to the hip and leg supporting member and the swing traction unit.

8. The chair frame of claim 7, wherein the swing traction unit comprises a swing member and a backrest traction member pivotally connected to each other, the swing member is further pivotally connected to the hip supporting portion and configured to connect to the driving mechanism, and the backrest traction member is further pivotally connected to the back supporting member; and the auxiliary traction member further comprises a third pin joint portion fixed relative to the first pin joint portion and the second pin joint portion, and the auxiliary traction member is pivotally connected to the backrest traction member by the third pin joint portion.

9. The chair frame of claim 8, wherein the auxiliary traction member comprises a first rod and a second rod, and the first pin joint portion and the third pin joint portion are located at both ends of the first rod respectively; and the second rod is convex on a side of the first rod, an oblique angle is formed between the first rod and the second rod, and the second pin joint portion is located at an end of the second rod away from the first rod.

10. The chair frame of claim 9, wherein the first rod is integrated with the second rod; and/or a length of the second rod is less than that of the first rod, and a distance between an end of the second rod connected to the first rod and the third pin joint portion is at least three times longer than a distance between the end of the second rod connected to the first rod and the first pin joint portion.

11. The chair frame of claim 7, wherein the linkage member comprises a third rod and a fourth rod, a bending angle is formed between the third rod and the fourth rod; a first end of the third rod is pivotally connected to the back supporting member, a second end of the third rod is fixed to the fourth rod, and an end of the fourth rod away from the third rod is pivotally connected to the second pin joint portion.

12. The chair frame of claim 7, wherein the hip supporting portion, the swing traction unit and the auxiliary traction member form a first connecting rod mechanism, which is configured to drive an end of the swing traction unit connected to the back supporting member to move towards or away from the leg supporting portion; and the auxiliary traction member, the swing traction unit, the back supporting member and the linkage member form a second connecting rod mechanism, which is configured to change a supporting angle of the back supporting member.

13. The chair frame of claim 7, wherein the chair frame further comprises a footrest extension mechanism which is pivotally connected to the leg supporting portion, the driving mechanism is connected to the footrest extension mechanism for driving, and the adjusting mechanism for sitting postures is connected to the footrest extension mechanism for following moving thereof;

the driving mechanism is capable of running forward to drive the footrest extension mechanism to extend relative to the hip and leg supporting member, and driving the swing traction unit to move by the adjusting mechanism for sitting postures, resulting in driving the back supporting member to move towards the leg supporting portion; or the driving mechanism is capable of running in reverse to drive the adjusting mechanism for the sitting postures, resulting in making the swing traction unit to drive the back supporting member to move away from the leg supporting portion and drive the footrest extension mechanism to retract relative to the hip and leg supporting member.

14. The chair frame of claim 13, wherein the chair frame further comprises a first transmission rocker arm, a first transmission connecting rod and a second transmission connecting rod, the first transmission rocker arm is rotationally mounted on the hip and leg supporting member, both ends of the first transmission connecting rod are pivotally connected to a first end of the first transmission rocker arm and the adjusting mechanism for sitting postures respectively, and both ends of the second transmission connecting rod are pivotally connected to a second end of the first transmission rocker arm and the footrest extension mechanism respectively.

15. A chair, wherein the chair comprises the chair frame of claim 7.

16. The chair of claim 15, wherein the swing traction unit comprises a swing member and a backrest traction member pivotally connected to each other, the swing member is further pivotally connected to the hip supporting portion and configured to connect to the driving mechanism, and the backrest traction member is further pivotally connected to the back supporting member; and the auxiliary traction member further comprises a third pin joint portion fixed relative to the first pin joint portion and the second pin joint portion, and the auxiliary traction member is pivotally connected to the backrest traction member by the third pin joint portion.

17. The chair of claim 16, wherein the auxiliary traction member comprises a first rod and a second rod, and the first pin joint portion and the third pin joint portion are located at both ends of the first rod respectively; and the second rod is convex on a side of the first rod, an oblique angle is formed between the first rod and the second rod, and the second pin joint portion is located at an end of the second rod away from the first rod.

18. The chair of claim 17, wherein the first rod is integrated with the second rod; and/or a length of the second rod is less than that of the first rod, and a distance between an end of the second rod connected to the first rod and the third pin joint portion is at least three times longer than a distance between the end of the second rod connected to the first rod and the first pin joint portion.

19. The chair of claim 15, wherein the linkage member comprises a third rod and a fourth rod, a bending angle is formed between the third rod and the fourth rod; a first end of the third rod is pivotally connected to the back supporting member, a second end of the third rod is fixed to the fourth rod, and an end of the fourth rod away from the third rod is pivotally connected to the second pin joint portion.

20. The chair of claim 15, wherein the hip supporting portion, the swing traction unit and the auxiliary traction member form a first connecting rod mechanism, which is configured to drive an end of the swing traction unit connected to the back supporting member to move towards or away from the leg supporting portion; and the auxiliary traction member, the swing traction unit, the back supporting member and the linkage member form a second connecting rod mechanism, which is configured to change a supporting angle of the back supporting member.

* * * * *